US011362466B2

(12) United States Patent
Droesbeke et al.

(10) Patent No.: US 11,362,466 B2
(45) Date of Patent: Jun. 14, 2022

(54) ELECTRICAL CONNECTOR AND CONNECTOR ASSEMBLY

(71) Applicant: Aptiv Technologies Limited, St. Michael (BB)

(72) Inventors: Gert Droesbeke, Erkrath (DE); Paul Pigmann, Tilburg (NL); Martin Ludwig, Wuppertal (DE)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/997,859

(22) Filed: Aug. 19, 2020

(65) Prior Publication Data

US 2021/0057853 A1 Feb. 25, 2021

(30) Foreign Application Priority Data

Aug. 20, 2019 (EP) ..... 19192600

(51) Int. Cl.
*H01R 13/6592* (2011.01)
*H01R 4/02* (2006.01)
(Continued)

(52) U.S. Cl.
CPC ..... *H01R 13/6592* (2013.01); *H01R 4/029* (2013.01); *H01R 4/187* (2013.01); *H01R 4/20* (2013.01); *H01R 4/72* (2013.01); *H01R 9/0518* (2013.01); *H01R 13/6582* (2013.01); *H01R 13/6593* (2013.01); *H01R 43/0221* (2013.01); *H01R 2201/26* (2013.01)

(58) Field of Classification Search
CPC ..... H01R 13/6592; H01R 4/187; H01R 13/6593; H01R 4/029; H01R 4/20; H01R 4/72; H01R 43/0021; H01R 4/185; H01R 13/6582; H01R 9/0518; H01R 13/502; H01R 13/02; H01R 13/648; H01R 24/00; H01R 2201/26; H01R 13/66; H01R 13/46; H01R 13/6581; H01R 4/12
USPC ..... 439/607.5, 607.55, 607.56
See application file for complete search history.

(56) References Cited

U.S. PATENT DOCUMENTS 7,422,480 B1 9/2008 Musick et al.
9,831,615 B2 * 11/2017 Saito ..... H01R 13/6596
(Continued)

FOREIGN PATENT DOCUMENTS

CN 103682934 A 3/2014
CN 106207585 A 12/2016
(Continued)

OTHER PUBLICATIONS

First Chinese Office Action for CN Application No. 202010816827.5, dated Nov. 23, 2021, 9 pages.

*Primary Examiner* — Travis S Chambers
(74) *Attorney, Agent, or Firm* — Billion & Armitage

(57) ABSTRACT

An electrical connector includes an inner signal contact, an outer shielding contact, and a cover. The outer contact has a crimping portion including a first crimp wing and a second crimp wing that are bendable towards each other to attach the outer shielding contact to a cable such that ends of the first crimp wing and the second crimp wing extend towards each other when the outer shielding contact is attached to the cable. The cover is configured to cover a braid or a protective layer of the cable that is arranged underneath the ends of the crimp wings when the outer shielding contact is attached to the cable.

17 Claims, 15 Drawing Sheets

(51) Int. Cl.

| | |
|---|---|
| ***H01R 4/20*** | (2006.01) |
| ***H01R 4/72*** | (2006.01) |
| ***H01R 13/6593*** | (2011.01) |
| ***H01R 4/18*** | (2006.01) |
| ***H01R 13/6582*** | (2011.01) |
| ***H01R 9/05*** | (2006.01) |
| *H01R 43/02* | (2006.01) |

(56) References Cited

U.S. PATENT DOCUMENTS

| | | | | |
|---|---|---|---|---|
| 10,008,809 | B2 * | 6/2018 | Maesoba | H01R 13/648 |
| 10,283,924 | B2 * | 5/2019 | Bauer | B23K 26/21 |
| 10,312,605 | B2 * | 6/2019 | Hamada | H01R 13/648 |
| 10,381,785 | B2 * | 8/2019 | Maesoba | H01R 4/184 |
| 10,490,928 | B2 * | 11/2019 | Matsui | H01R 13/6581 |
| 10,686,260 | B2 * | 6/2020 | Wang | H01R 4/027 |
| 10,770,822 | B2 * | 9/2020 | Maesoba | H01R 24/40 |
| 10,790,617 | B2 * | 9/2020 | Takahashi | H01R 13/6593 |
| 10,833,456 | B2 * | 11/2020 | Maesoba | H01R 4/184 |
| 2003/0092321 | A1 * | 5/2003 | Schauer | H01R 9/0518 439/607.41 |
| 2005/0266727 | A1 | 12/2005 | Yamaguchi et al. | |
| 2011/0220408 | A1 * | 9/2011 | Walsh | A61N 1/05 174/75 R |
| 2015/0155670 | A1 * | 6/2015 | Gardner | H01R 13/5208 439/587 |
| 2018/0026401 | A1 * | 1/2018 | Kanda | H01R 13/6473 439/607.5 |
| 2018/0351305 | A1 | 12/2018 | Maesoba et al. | |
| 2021/0057854 | A1 * | 2/2021 | Droesbeke | H01R 13/6593 |
| 2021/0057855 | A1 * | 2/2021 | Droesbeke | H01R 43/20 |
| 2021/0066856 | A1 * | 3/2021 | Droesbeke | H01R 4/183 |

FOREIGN PATENT DOCUMENTS

| | | | | |
|---|---|---|---|---|
| CN | 107645083 | A | 1/2018 | |
| DE | 10358153 | B4 * | 1/2008 | H01R 43/0221 |
| DE | 102010038465 | A1 * | 2/2012 | H01R 4/18 |
| DE | 102010035424 | A1 * | 3/2012 | B23K 26/22 |
| EP | 2942841 | A2 | 11/2015 | |
| EP | 3273542 | A1 | 1/2018 | |
| FR | 3074614 | A1 | 6/2019 | |
| JP | H0722107 | A | 1/1995 | |
| WO | WO-2018142887 | A1 * | 8/2018 | H01R 13/6593 |

* cited by examiner

ELECTRICAL CONNECTOR AND CONNECTOR ASSEMBLY

CROSS-REFERENCE TO RELATED APPLICATION

This application claims the benefit of priority to European Patent Application No. 19192600.5, filed Aug. 20, 2019, the entire disclosure of which is hereby incorporated herein by reference.

TECHNICAL FIELD OF THE INVENTION

The invention generally relates to an electrical connector, particularly an electrical connector and connector assembly suited for transmitting digital data in an automotive environment.

BACKGROUND OF THE INVENTION

Automobiles are including systems that depend on the reliable transmission of high-speed digital data for high-resolution camera systems (e.g. 4K), autonomous driving, RADAR, LIDAR, high-resolution displays, and rear seat entertainment. Electrical connectors for these systems need to meet the environmental requirements of an automobile, e.g. vibration, operating temperature, EMI, EMC, as well as having a small size to simplify packaging the connector within an automobile.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, an electrical connector is provided. The electrical connector includes an inner signal contact and an outer shielding contact. The outer contact has a crimping portion including a first crimp wing and a second crimp wing bendable towards each other to attach the outer shielding contact to a cable such that ends of the first crimp wing and the second crimp wing extend towards each other when the outer shielding contact is attached to the cable. The electrical connector further includes a cover for covering a braid or a protective layer of the cable arranged underneath the ends of the crimp wings when the outer shielding contact is attached to the cable.

In an example embodiment having one or more features of the electrical connector of the previous paragraph, the cover may be formed of sheet metal.

In an example embodiment having one or more features of the electrical connector of any one of the previous paragraphs, the outer shielding contact may include a first outer contact part and a second outer contact part. The first outer contact part may form the first and second crimp wings and the second outer contact part may form the cover.

In an example embodiment having one or more features of the electrical connector of any one of the previous paragraphs, the first outer contact part or the second outer contact part may be generally formed as a half shell.

In an example embodiment having one or more features of the electrical connector of any one of the previous paragraphs, the first outer contact part or the second outer contact part may be formed from sheet metal.

In an example embodiment having one or more features of the electrical connector of any one of the previous paragraphs, the first crimp wing may define a first peripheral front face and the second crimp wing may define a second peripheral front face corresponding to the first peripheral front face.

In an example embodiment having one or more features of the electrical connector of the previous paragraph, the first peripheral front face may include a step portion and the second peripheral front face may include a corresponding step portion.

In an example embodiment having one or more features of the electrical connector of any one of the previous paragraphs, the cover may have an arcuate shape.

In an example embodiment having one or more features of the electrical connector of any one of the previous paragraphs, the first crimp wing or the second crimp wing may be provided with openings for welding the first crimp wing or the second crimp wing to the cover.

In an example embodiment having one or more features of the electrical connector of any one of the previous paragraphs, the outer contact may form a plurality of spring contacts arranged around the inner signal contact in a region of the connector opposite from the crimping portion.

According to another embodiment of the invention, a connector assembly is provided. The connector assembly includes the electrical connector of any one of the previous paragraphs and a shielded cable attached to the crimping portion of the outer shielding contact.

In an example embodiment having one or more features of the connector assembly of the previous paragraph, the cable may include two inner wires and an outer shield and the cover may be in direct contact with the outer shield.

In an example embodiment having one or more features of the connector assembly of any one of the previous paragraphs, the shield may be formed as a braid.

In an example embodiment having one or more features of the electrical connector of any one of the previous paragraphs, the two inner wires may be twisted one about the other.

In an example embodiment having one or more features of the electrical connector of any one of the previous paragraphs, the two inner wires may be arranged parallel with one another.

In an example embodiment having one or more features of the electrical connector of any one of the previous paragraphs, an outer crimping tube or shrink tube may be arranged around the crimping portion.

In an example embodiment having one or more features of the electrical connector of any one of the previous paragraphs, the first crimp wing and the second crimp wing may be configured to touch each other when the connector is attached to the cable.

In an example embodiment having one or more features of the electrical connector of any one of the previous paragraphs, peripheral front faces of the first crimp wing and the second crimp wing may be configured to touch each other when the connector is attached to the cable.

In an example embodiment having one or more features of the electrical connector of any one of the previous paragraphs, the first crimp wing and the second crimp wing may be welded together when the electrical connector is attached to the cable.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
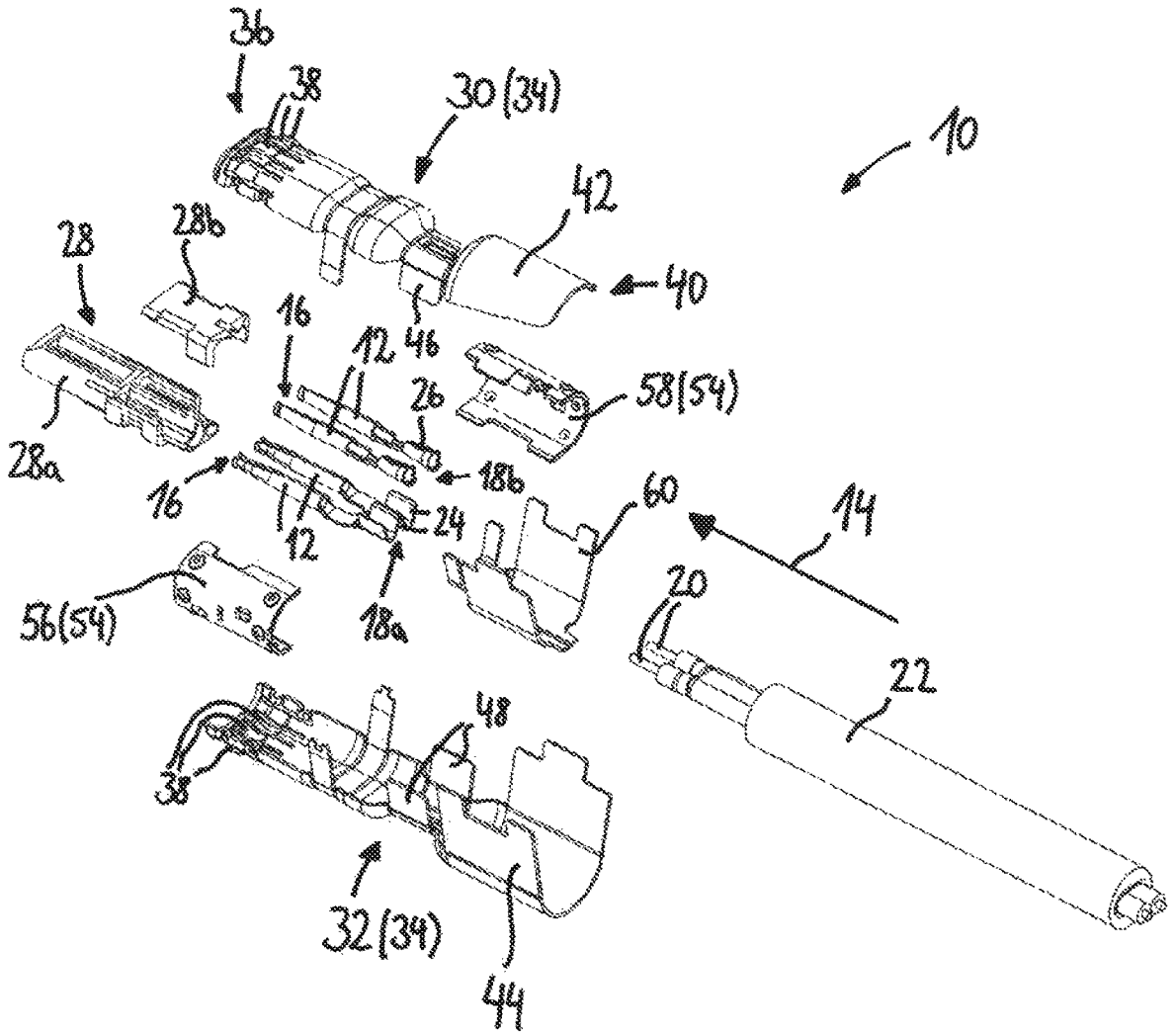
FIG. 1 is an exploded view of an electrical connector according to some embodiments.

FIG. 1 illustrates an exploded view of a connector 10, particularly a female connector, comprising two elongated inner signal contacts 12 arranged generally parallel to each other along a plug or axial direction 14 of the connector 10. The signal contacts 12 have a first connection portion 16 for connecting the connector 10 to a mating connector, particularly a mating male connector, and a second connection portion 18 for connecting the signal contacts 12 to respective conductors or wires 20 of a cable 22. The second connection portion 18, as illustrated by the two alternatives shown in FIG. 1, can be formed as a crimping portion 18*a* having two crimping wings 24 or can be formed as a welding portion 18*b* having a welding opening 26. The welding opening 26 can be used to connect the signal contacts 12 to respective conductors or wires 20 of the cable 22 via laser welding. Alternatively, resistance welding can be used to connect the signal contacts 12 to respective conductors or wires 20 of the cable 22.

An insulating element 28, e.g. a dielectric housing, is arranged around the inner signal contacts 12. In the embodiment shown in FIG. 1, the insulating element 28 is formed of two separate parts 28*a* and 28*b*. The first and second parts 28*a*, 28*b* of the insulating element 28 are attachable to each other by a click-on connection, i.e. a snap fit engagement. The second part 28*b* fulfills the task of locking the signal contacts 12 in an axial direction so that the inner signal contacts 12 remain in their axial position when the connector 10 is connected to a mating connector. A more detailed explanation of this feature will be presented in the description of FIGS. 14 and 15.

The connector 10 further includes a first shielding part 30 and a second shielding part 32 both formed as half shells which together form an outer shielding contact 34. The outer shielding contact 34 surrounds the inner signal contacts 12 and the insulating element 28 to provide an electromagnetic shield against interfering signals. In addition, the outer shielding contact 34 can also be used as an electrical conductor to conduct electric power. At a distal end 36 of the connector 10, the outer shielding contact 34 includes multiple shielding contacts 38 which are discussed in more detail in the description of FIGS. 8 and 9. At a proximal end 40 of the connector 10, the first shielding part 30 forms a cover 42 which is discussed in more detail in regard to FIG. 7B. The second shielding part 32 forms a crimping portion 44 at the proximal end 40 of the connector 10 to connect the outer shielding contact 34 mechanically and electrically to the cable 22. Furthermore, the first and second shielding parts 30, 32 each define wings 46, 48 to create an inner shield 50 and an outer shield 52 overlapping the inner shield 50. A more detailed description of the inner and outer shield 50, 52 is presented in the description of FIGS. 6A and 6B.

To better secure the connection between the first shielding part 30 and the second shielding part 32, a cover 54 comprising a first cover part 56 and a second cover part 58 are placed around the first and second shielding parts 30, 32 and are connected to each other, in particular via a click-on connection. The first and second cover parts 56, 58 have a C-shaped cross section so that they can each be placed around a half of the first shielding part 30 and the second shielding part 32. Furthermore, the connector 10 includes an inner crimp ferrule 60 which is placed around the cable 22.

Figure 2A:
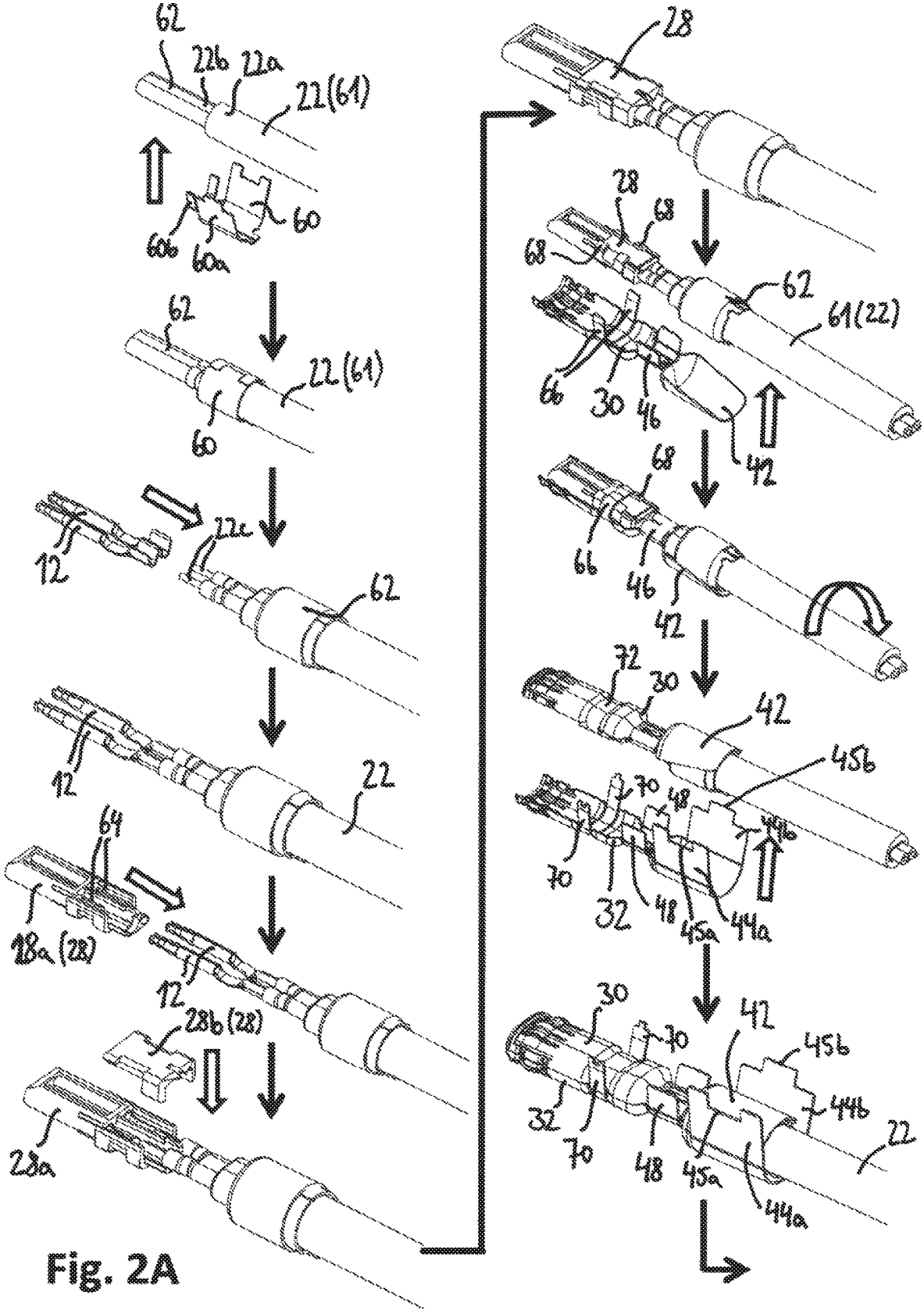
FIG. 2A to 2C is an assembly sequence view of the connector of FIG. 1 according to some embodiments.
Figure 2B:
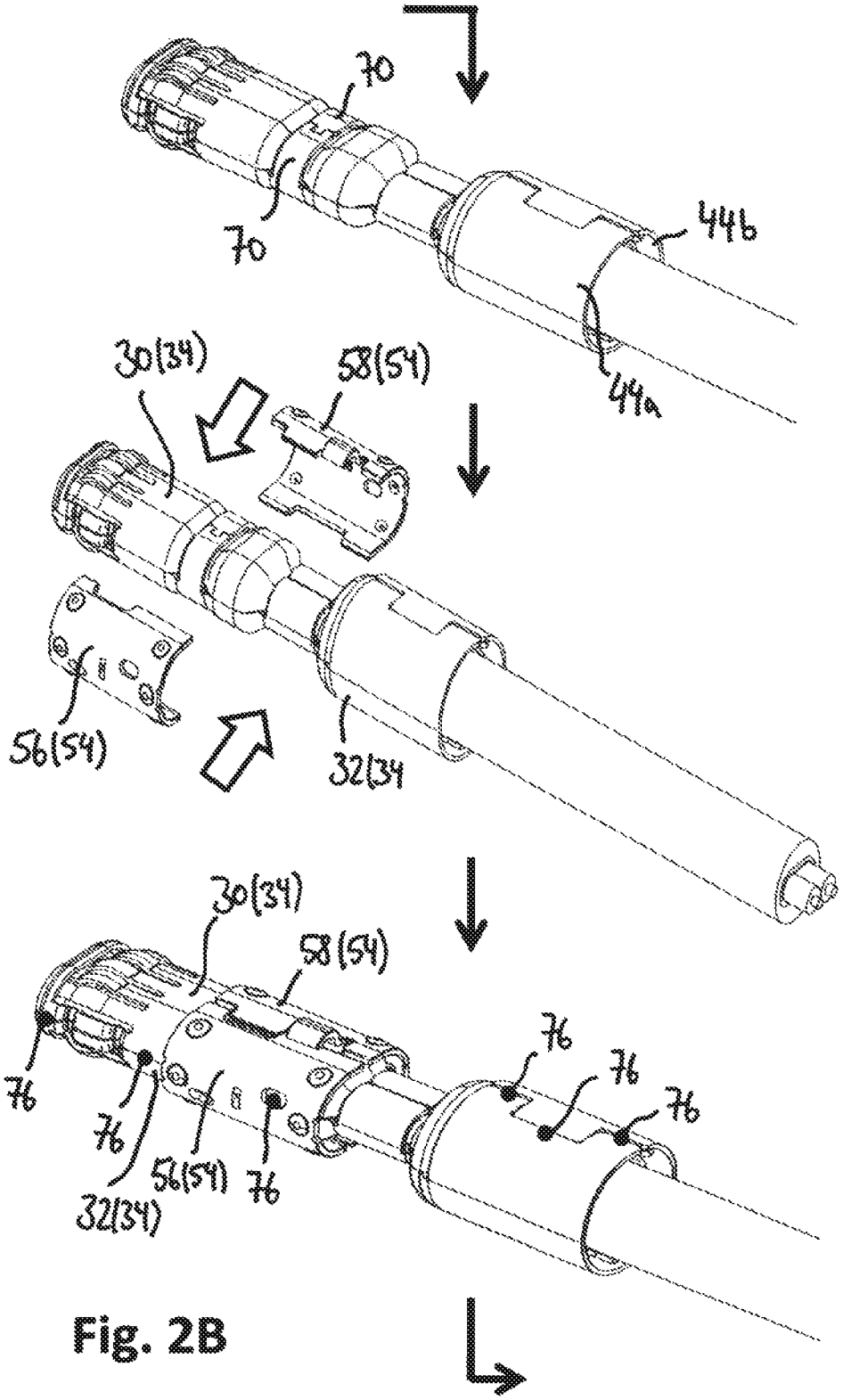
Figure 2C:
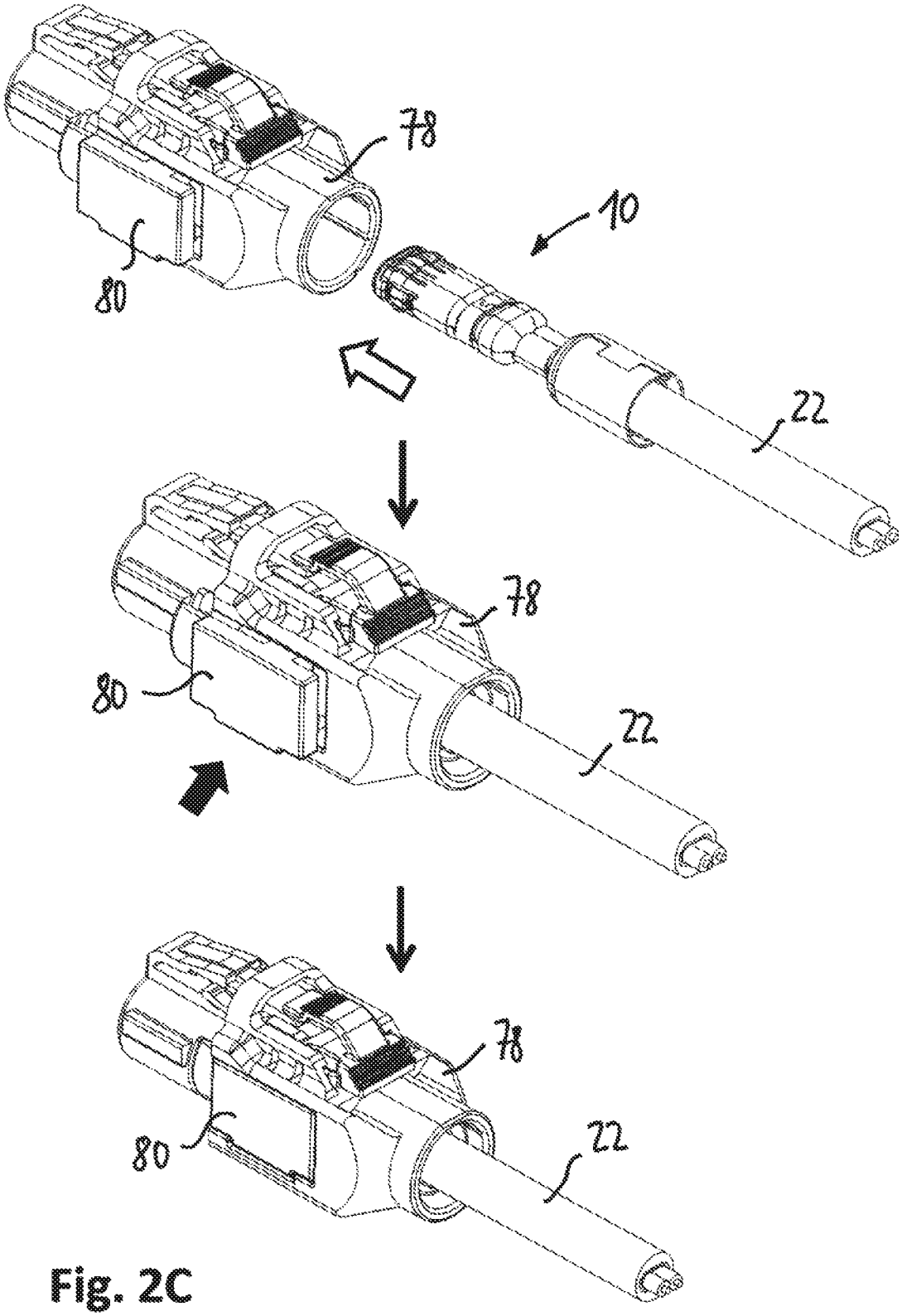

FIGS. 2A to 2C illustrate an assembly instruction for the connector 10 of FIG. 1. In a first step, the inner crimp ferrule 60 is crimped onto the cable 22. The inner crimp ferrule 60 has a first portion 60*a* that is crimped around portion 22*a* of the cable 22 where a protection layer 61 is the outermost layer of the cable 22. The inner crimp ferrule 60 further has a second part which is formed around a portion 22*b* of the cable 22 where a shield layer 62 of the cable 22 is the outermost layer of the cable 22, i.e. where the protection layer 61 has been removed. After the inner crimp ferrule 60 is connected to the cable 22, the shield layer 62 is folded backwards over the inner crimp ferrule 60. Additionally, end sections 22*c* of the cable 22 are stripped so that the conductors or wires 20 of the cable 22 are not surrounded by insulation material anymore. In the next step, the inner signal contacts 12 are connected to the stripped sections 22*c* of the wires 20. While the inner signal contacts 12 are connected via crimping in the shown embodiment, the electrical connection between the inner signal contacts 12 and the wires 20 can be improved if the connection is established by welding, in particular laser welding. To improve cycle time of this connecting step, the two inner signal contacts 12 can be connected to the stripped sections of the wires 20 simultaneously.

After the inner signal contacts 12 are attached to the wires 20, the first part 28*a* of the insulating element 28 is put on the inner signal contacts 12 from the axial direction 14 so that the inner signal contacts 12 are arranged in axial channels 64 of the first part 28*a* of the insulating element 28. Then, the second part 28*b* of the insulating element 28 is attached to the first part 28*a* of the insulating element 28 from a radial direction. Thereby, the inner signal contacts 12 are axially fixed to the insulating element 28.

After the insulating element 28 is connected to the inner signal contacts 12, the first shielding part 30 is placed onto a section extending from a distal end of the insulating element 28 to a section of the cable 22 where the shield layer 62 is folded backwards onto the protection layer 61 of the cable 22. In order to connect the first shielding part 30 to the insulating element 28, the first shielding part 30 includes two connecting wings 66 which are bent around the insulating element 28 in order to radially fixate the first shielding part 30 onto the insulating element 28. For axial fixation of the first shielding part 30, blocking elements 68 are formed on an outer surface of the insulating element 28. The blocking elements 68 engage with the connecting wings 66 to limit or prevent axial movement of the first shielding part 30. Furthermore, in a section of the cable 22 right before the distance between the wires 20 is increased, the shielding wings 46 are placed onto the cable 22 and bent almost all the way around the wires 20 and their respective insulation (cf. FIG. 6B). By placing the first shielding part 30 onto the insulating element 28 and the cable 22, the cover 42 contacts the back-folded portion of the shield layer 62.

For simplifying explanation of the method of assembling, the assembly is turned in the figures. However, this is not a necessary step in production.

After the first shielding part 30 is securely fixed to the insulating element 28 and the cable 22, the second shielding part 32 is attached to the assembly from an opposite radial side. The second shielding part 32 includes connecting wings 70 which are bent around the first shielding part 30 to radially fixate the second shielding part 32 onto the first shielding part 30. A groove 72 extending perpendicular to the axial direction 14 is formed on the outer surface of the first shielding part 30 into which the connecting wings 70 of the second shielding part 32 are placed. The second shielding part 32 is thereby axially fixated onto the first shielding part 30. Additionally, a rather smooth outer surface of the shielding contact 34 is generated.

The second shielding part 32 further includes the wings 48 which are positioned in a corresponding axial section to the section of the wings 46. In order to establish a so called "EMC-labyrinth", i.e. a shield where interference signals are attenuated, the second wings 48, same as the wings 46, are bent so that they almost completely surround the respective section of the cable 22. Since the first and second shielding parts 30, 32 are placed around the cable from opposite sides, gaps 74, 75 (cf. FIG. 6B) which are present at least in an axial section between peripheral end sections 46*a*, 46*b*, 48*a*, 48*b* of the wings 46, 48 are positioned on opposite sides of the cable 22.

The second shielding part 32 also includes the crimping portion 44 which is arranged in a corresponding axial section to the section of the cover 42 of the first shielding part 30. The crimping portion 44 includes two crimp wings 44*a*, 44*b* which are bent around the cable 22 and the cover 42 of the first shielding part 30. The crimp wings 44*a*, 44*b* define corresponding peripheral ends 45*a*, 45*b*. The cover 42 is helpful to hold the shield layer 62, usually a braid, down while the crimp wings 44*a*, 44*b* are bent around the cable 22. It has been found that providing such a cover 42 improves production quality and robustness against cable damage.

After the second shielding part 32 is fixated on the first shielding part 30, the cover 54 is placed around the first and second shielding parts 30, 32 to secure the connection between the first and second shielding parts 30, 32. The cover 54, as mentioned before, includes two parts: the first cover part 56 and the second cover part 58. The first cover part 56 is positioned around portions of the first and second shielding parts 30, 32 from a radial direction different from the directions from which the first and second shielding parts 30, 32 are placed onto the assembly. The second cover part 58 is also positioned around portions of the first and second shielding parts 30, 32 from a radial direction different from the directions from which the first and second shielding parts 30, 32 and the first cover part 56 are placed onto the assembly. In particular, the first and second cover parts 56, 58 are placed onto the first and second shielding parts 30, 32 from opposite radial directions. To connect the first and second cover parts 56, 58 together, connecting means are provided at the first and second cover parts 56, 58, in particular snap fit engagement means.

After the first and second cover parts 56, 58 are connected to each other, the first and second shielding parts 30, 32 are welded together at welding positions 76. Then, the connector 10 is inserted into a connector housing 78, in particular a female connector housing. To attach the connector housing 78 to the connector 10, the connector housing 78 includes terminal position assurance (TPA) device in form of a pusher 80. The pusher 80 is pushed radially into the connector housing 78 to axially connect the connector housing 78 to the connector 10.

Figure 3:
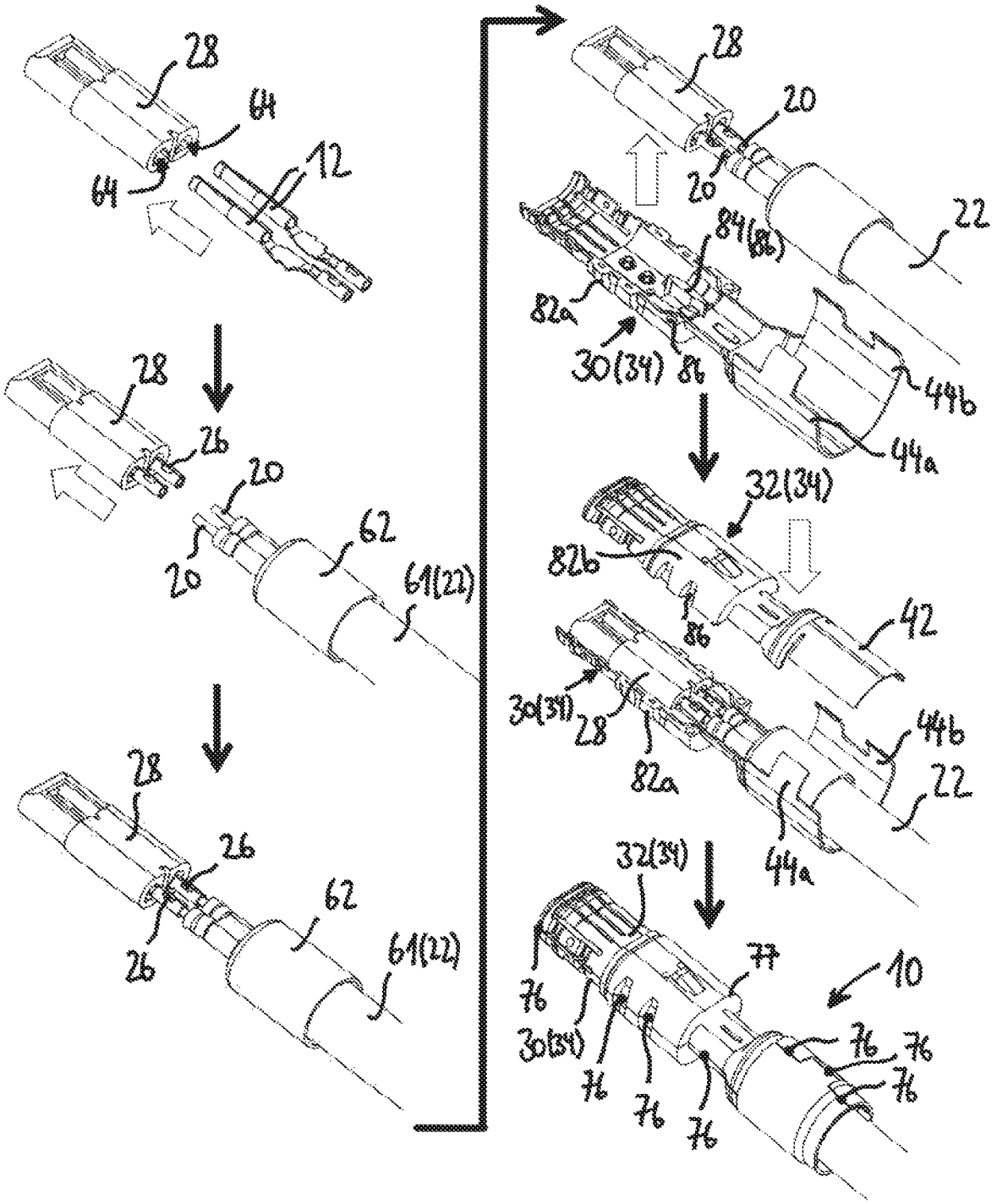
FIG. 3 is an assembly sequence view of a second connector according to some embodiments.
Figure 14:
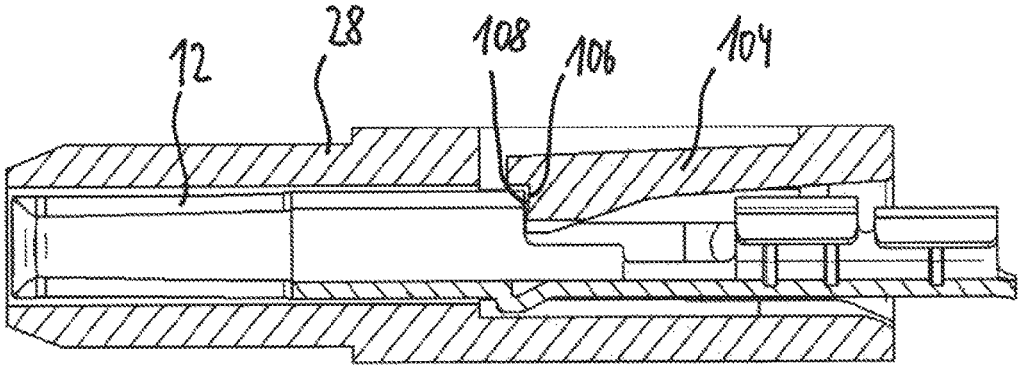
FIG. 14 is a cross-sectional side view of a signal contact embedded in an insulating element according to some embodiments.

FIG. 3 illustrates an assembly instruction for a connector 10 according to a second embodiment. According to the assembly method, the inner signal contacts 12 are axially inserted into the insulating element 28. In this example, the insulating element 28 is formed as a single integral part. In the insulating element 28, two axial channels 64 are formed which receive the inner signal contacts 12. The inner signal contacts 12 can be axially fixated on the insulating element 28 by a snap-lock connection as shown in FIG. 14. The inner signal contacts 12 can alternatively or additionally be axially fixated on the insulating element 28 by hooks 103 (FIG. 12A) or dimples formed on the inner signal contacts 12 and interfering with the insulating element 28. An insertion depth controlled by an assembly machine can be used to make sure that both inner signal contacts 12 are inserted the same distance into the insulating element 28. After the inner signal contacts 12 are pre-assembled with the insulating element 28, the inner signal contacts 12 are connected to the wires 20 by laser or resistance welding.

After the inner signal contacts 12 are connected to the wires 20, a first shielding part 30 is placed around the insulating element 28 and the cable 22. However, compared to the assembly process described regarding FIGS. 2A to 2C, the first shielding part 30 placed around the insulating element 28 has the crimp wings 44*a*, 44*b*. A second difference between the assembly processes is that the first shielding part 30 in FIG. 3 has an insulating layer 82*a* which was molded over a section of the first shielding part 30. The insulating layer 82*a* includes a rib 84 which is placed between the two wires 20 of the cable 22 to establish a further insulation between the wires 20. After the first shielding part 30 is placed around the insulating element 28 and the cable 22, a second shielding part 32 is also placed around the insulating element 28 and the cable 22. The second shielding part 32 also has as an insulating layer 82*b* which was molded over a section of the second shielding part 32. As can be seen in FIG. 3, the insulating layers 82*a* and 82*b* together form an insulating layer 82 formed on the inside an the outside of the first and second shielding parts 30, 32. This insulating layer 82 allows forming multiple quality control elements 86 which can be used to evaluate whether the first and second shielding parts 30, 32 are joined together correctly and whether the wires 20 and/or the insulating element 28 are located in the right place.

After placing the second shielding part 32 onto the first shielding part 30, the crimp wings 44*a*, 44*b* of the first shielding part 30 are crimped around the cover 42 of the second shielding part 32 and the first and second shielding parts 30, 32 are connected to each other via laser welding.

Figure 4:
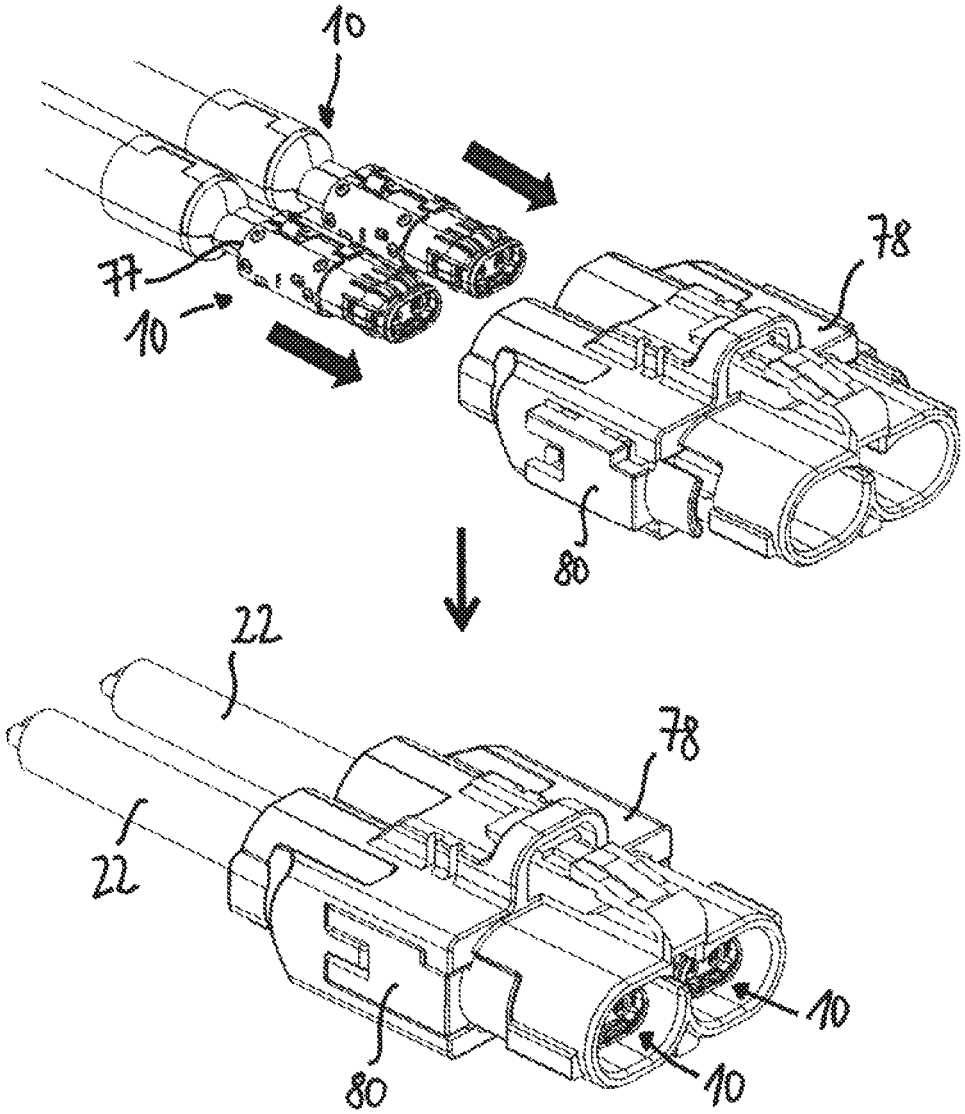
FIG. 4 is an assembly sequence view of a 2-Port connector with two of the connectors of FIG. 1 according to some embodiments.
Figure 5:
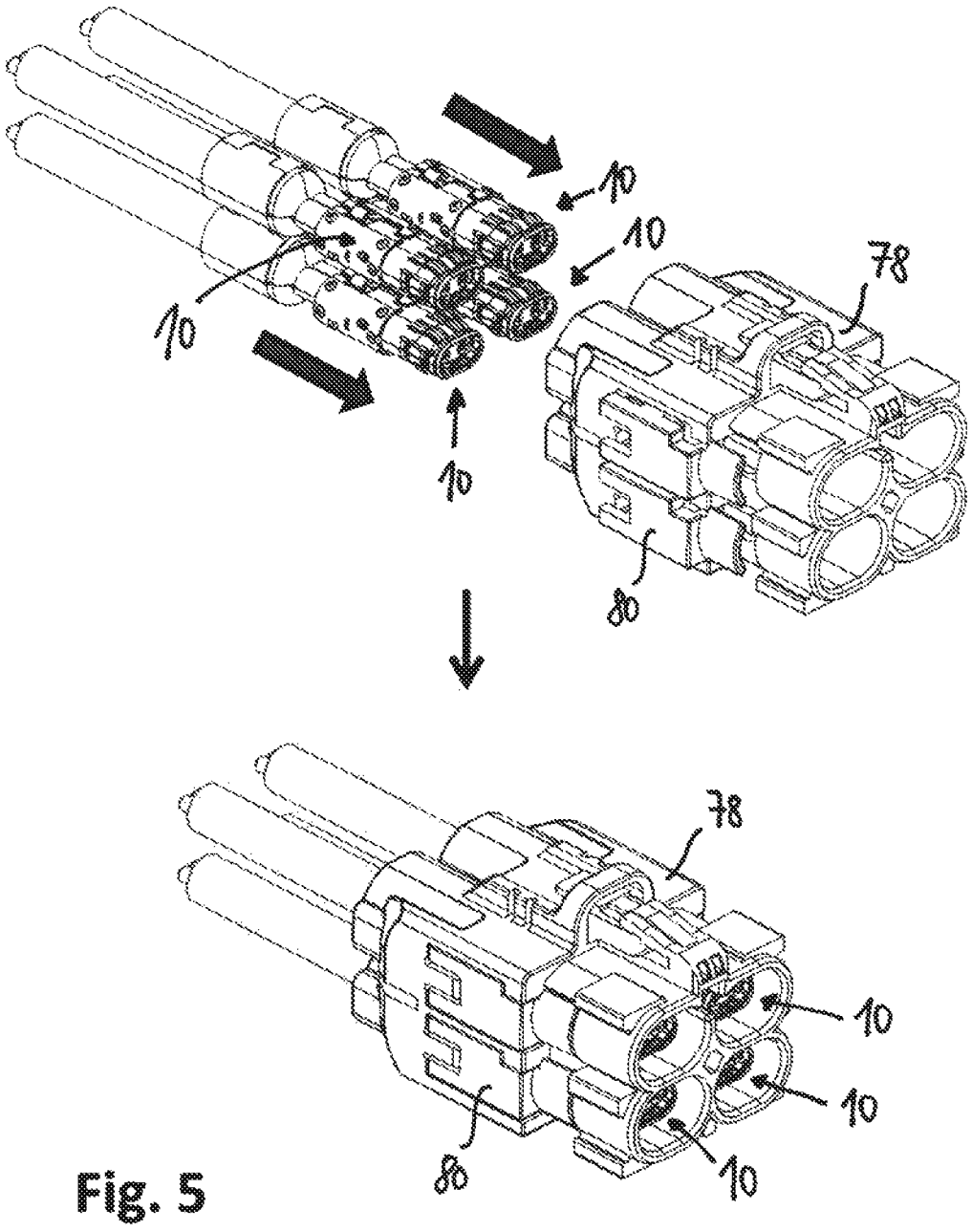
FIG. 5 is an assembly sequence view of a 4-Port 2-Row connector with four of the connectors of FIG. 1 according to some embodiments.

FIGS. 4 and 5 illustrate options for grouping multiple connectors 10 together. In FIG. 4 a connector collector housing 78 is shown that is connected to two female connectors 10. The cover parts 56, 58 or the insulating layers 82*a* and 82*b* (FIG. 3), in particular their rear edges 77, can be used to securely lock the connectors 10 within the collector housing 78. They can be used to enable a primary and secondary lock of the connector 10 in the housing 78. Using such a connector collector housing 78 allows faster assembly of an electrical wiring harness of a car. In FIG. 5, a connector collector housing 78 capable of taking up four connectors 10 arranged in two lines and 2 rows is shown. This connector housing 78 allows connecting four cables 22 to mating cables at once.

Figure 6A:
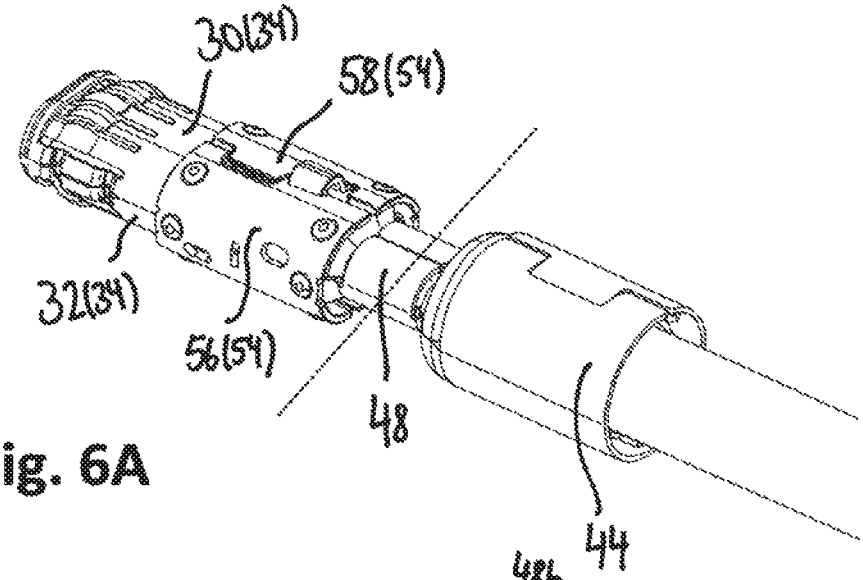
FIG. 6A is a perspective view of the connector of FIG. 1 from a proximal side according to some embodiments.
Figure 6B:
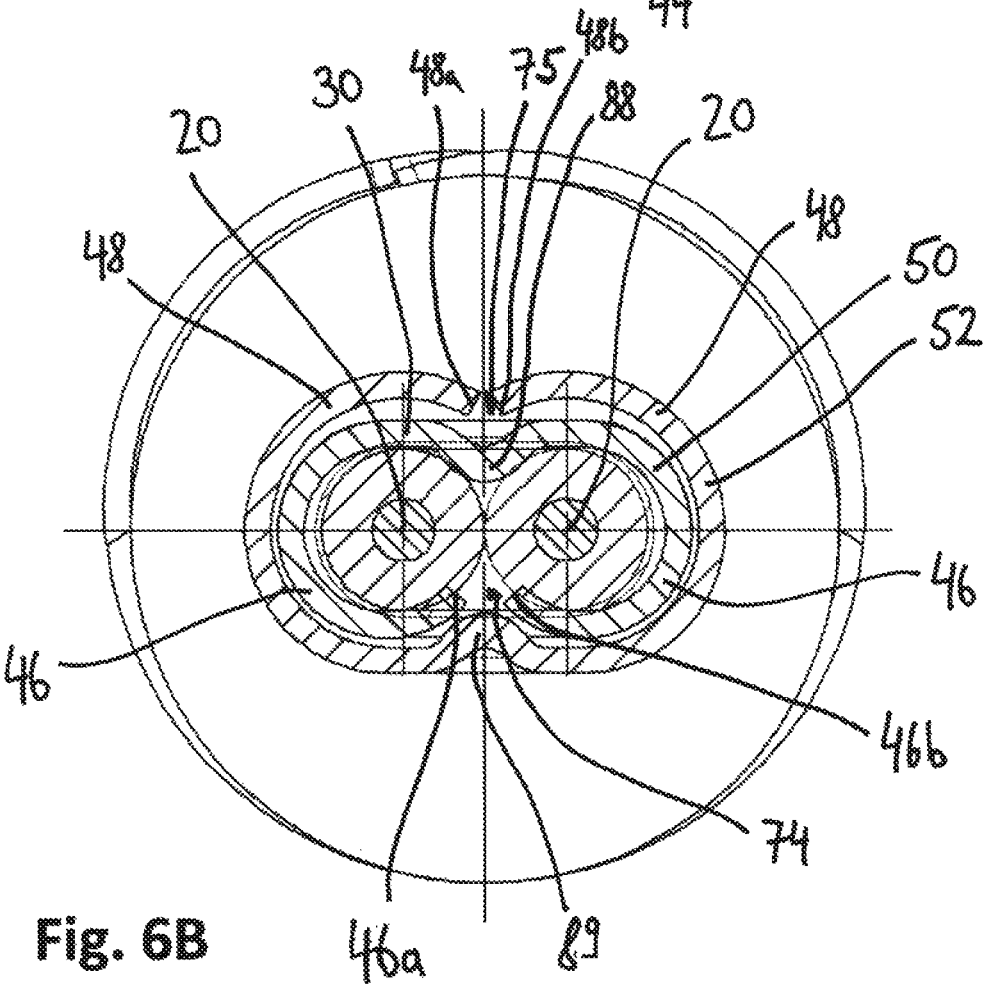
FIG. 6B is a cross-sectional view of the connector of FIG. 1 along the dashed line of FIG. 6A according to some embodiments.

FIGS. 6A and 6B illustrate a section of the connector 10 where wings 46, 48 of the first and second shielding parts 30, 32 are located. FIG. 6B shows a cross sectional view of the above-mentioned section along the dashed line shown in FIG. 6A. In an inner region of the connector 10, two insulated conductors or wires 20 extend generally parallel to each other. Around the wires 20, the inner shield 50 is formed by the wings 46 of the first shielding part 30. The inner shield 50 almost surrounds the wires 20. Only a small gap 74 is left between the peripheral ends of the 46*a*, 46*b* of the wing 46. As can be seen from FIG. 6B, the gap 74 is smaller than a distance between outer surfaces of the wires 20. At an opposite side of the gap 74, an embossment 88 is formed so that the inner shield 50 extends into a free space between insulations of the two wires 20. One could say that the inner shield 50 therefore has a cross sectional shape like two scuba tanks or scuba glasses. Around the inner shield 50, the outer shield 52 is formed. The outer shield 52 has a similar general shape as the inner shield 50 but it has a larger diameter. Therefore, a second gap 75 is present between the peripheral ends 48*a*, 48*b* of the wings 48. The gap 75 between the peripheral ends 48*a*, 48*b* of the wings 48 is located at the angular position of the embossment 88 formed in the wing 46. On the other hand, the outer shield 52 also forms an embossment 89 which is located at the angular position of the gap 74 of the inner shield 50. The two shields 50, 52 create an "EMC-labyrinth" which provides improved shielding to the wires 20 against interfering signals.

At an axial beginning and an axial end of the section where wings 46, 48 of the first and second shielding parts 30, 32 are located, namely the tunnel in tunnel section, the gaps 74 and 75 are closed by the embossment 89 being in contact with the wings 46*a* and 46*b*. The wings 46*a* and 46*b* can be pushed against the embossment 89 by mounting the cover 54 onto the first and second outer shielding contacts 30, 32. In order to make sure that the embossment 89 is in contact with the wings 46*a* and 46*b* only at the axial beginning and the axial end of the tunnel in tunnel section, the embossment can be larger and/or higher at the axial beginning and the axial end in comparison to a middle section of the embossment. As such, a return current which flows on the outer shielding contact 34 does not need to make any detours and can remain running in parallel and close by the signal currents.

Figure 7A:
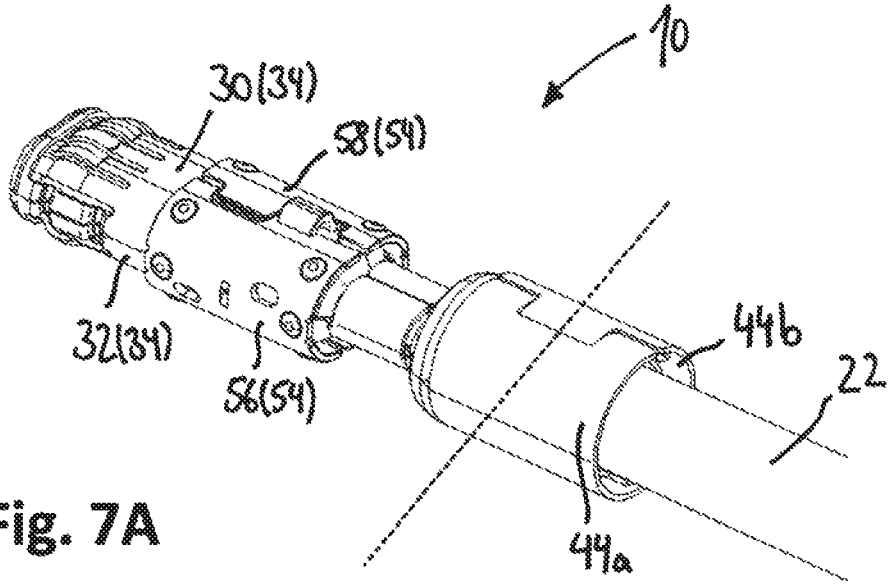
FIG. 7A is a perspective view of the connector of FIG. 1 from a proximal side according to some embodiments.
Figure 7B:
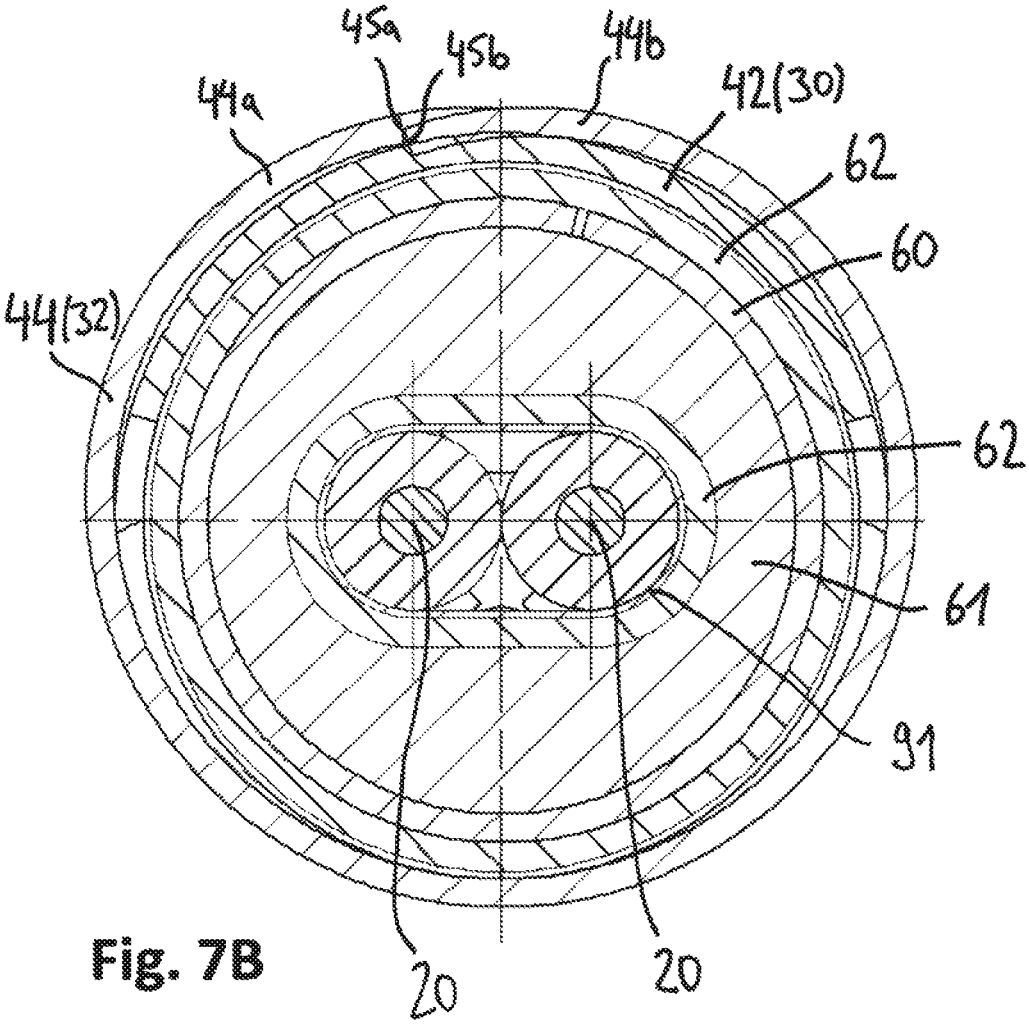
FIG. 7B is a cross-sectional view of the connector of FIG. 1 along the dashed line of FIG. 7A according to some embodiments.

FIGS. 7A and 7B illustrate a section of the connector 10 where the first and second shielding parts 30, 32 are connected to the cable 22. In a center of the cross-section illustrated in FIG. 7B, two insulated wires 20 are shown. Around the wires 20, a foil 91 is arranged. Then, the shield layer 62 of the cable 22 is arranged around the foil 91. The shield layer 62 of the cable 22 is formed as a braid. Around the shield layer 62, the protection layer 61 of the cable 22 usually forming the outmost layer of the cable 22 is arranged. In the section shown in FIG. 7B, the inner crimp ferrule 60 is attached to the outer surface of the protection layer 61. The shield layer 62 is folded backwards onto the inner crimp ferrule 60. On top of the back-folded shield layer 62, in a top section of the cable, the cover 42 of the first shielding part 30 is placed. On top of the cover 42 and the back-folded shield layer 62, the crimping portion 44 of the second shielding part 32 is placed. As can be seen from FIG. 7B, the peripheral ends 45*a*, 45*b* of the crimp wings 44*a*, 44*b* of the second shielding part 30 are placed in an angular section where the cover 42 covers the shield layer 62. Hence, the shield layer 62 is protected from the peripheral ends 45*a*, 45*b* of the crimp wings 44*a*, 44*b*.

Figure 8:
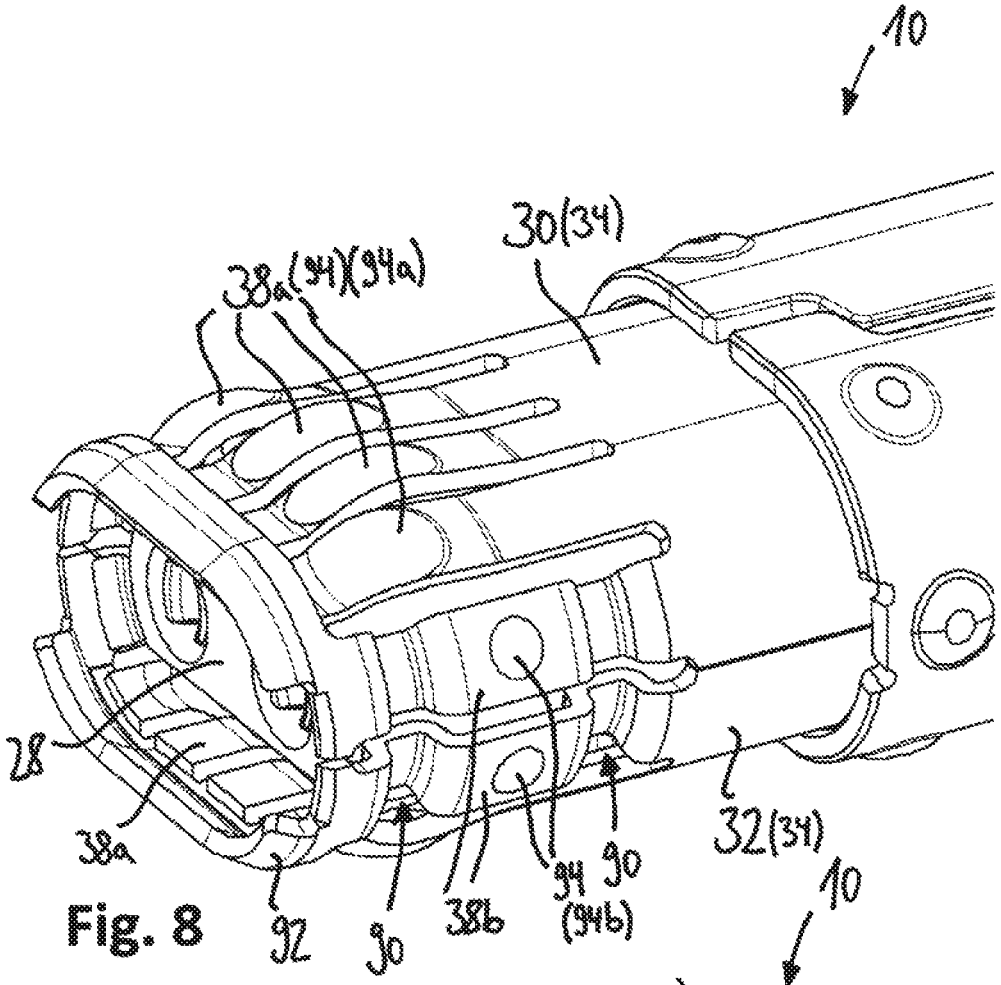
FIG. 8 is a perspective view of a distal end of a connector according to some embodiments.

FIG. 8 illustrates a distal end of the connector 10 according to a first embodiment. The shielding contact 34 is formed from the first and second shielding parts 30, 32. A distal end portion of the first and second shielding parts 30, 32 is mirror symmetrical so that the opposite side not shown in FIG. 8 of said distal end portion looks the same. The shielding contact is oval and thus has two longer sides and two shorter sides. At the longer sides, a first group 38*a* of shielding contacts 38 are positioned which generally extend in the axial direction 14 and are elastically deformable in a radial direction. At the shorter side of the connector 10, a second group 38*b* of shielding contacts 38 is formed on the shielding contact 34. The second group 38*b* of shielding contacts 38 consists of four shielding contacts 38*b* which each include two U-shaped portions 90. The U-shaped portions 90 are design so that the bottom part of each U-shaped portion 90 is closest to the insulating element 28 arranged at an inside of the shielding contact 34. The second group 38*b* of shielding contacts 38 is connected via a distal ring element 92. The distal ring element 92 is formed of two ring segments, each connecting two second group shielding contacts 38*b* of the respective first and second shielding part 30, 32. The distal ring element 92 holds the first group 38*a* of shielding contacts 38 in a pre-loaded position, i.e. the first group 38*a* of shielding contacts 38 push against an inner side of the distal ring element 92. This allows plugging the connecter 10 into a mating connector needing less force. The distal ring element 92 also prevents that ends of the shield contacts 38*a* can get caught by another element and be pulled outwards and thus be damaged. Furthermore, each of the shielding contacts 38 has a defined contact point 94 which is defined by an elevation at the outer surface of the respective contact 38. To lower the force needed to plug the connector 10 into a mating connector, some of the contact points 94 are axially spaced apart from other contact points 94. Contact points 94*a* of the first group 38*a* of shielding contacts 38 are axially distanced from contact points 94*b* of the second group 38*b* of shielding contacts 38. In the embodiment shown in FIG. 8, the first group 38*a* of shielding contacts 38 has two separate types of shielding contacts 38*a*, wherein the first type of shielding contacts 38*a*, the two inner shielding contacts, has contact points 94*a* which are axially distanced from contact points of the second type of shielding contacts 38*a*, the two outer shielding contacts.

Figure 9:
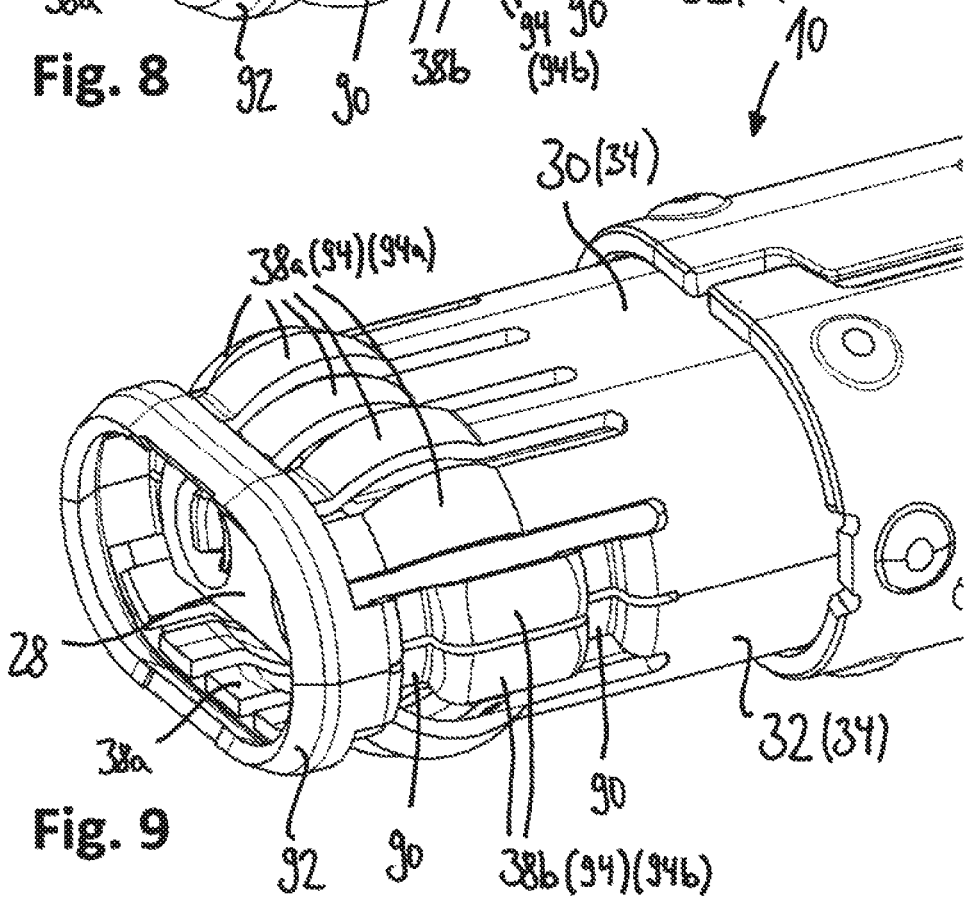
FIG. 9 is a perspective view of a distal end of a connector according to some embodiments.

FIG. 9 illustrates a distal end of the connector 10 according to a second embodiment. Instead of having a first group 38*a* of shielding contacts 38 having four upper contacts and four lower contacts 38*a*, the connector 10 has a first group 38*a* of shielding contacts 38 which consists of five upper contacts 38*a* and five lower contacts 38*a*. One of the first group 38*a* of shielding contacts 38 on each of the sides, the shielding contact 38*a* in the middle of the five shielding contacts 38, is designed as a sacrificial contact. Compared to the embodiment of FIG. 8, the distal ring element 92 of FIG. 9 is a closed ring element, i.e. the ring segments are connected to each other, e.g. by laser welding.

In both of the embodiments shown in FIGS. 8 and 9, the plurality of shielding contacts 38*a*, 38*b* are arranged symmetrically and generally equally distanced from each other. The plurality of shielding contacts 38*a*, 38*b* is integrally formed with their respective first or second shielding part 30, 32. The segments of the distal ring element 92 are also integrally formed with their respective first or second shielding part 30, 32. The first and second shielding parts 30, 32 can be made from sheet-metal and can be designed as a stamped/bent part.

Figure 10A:
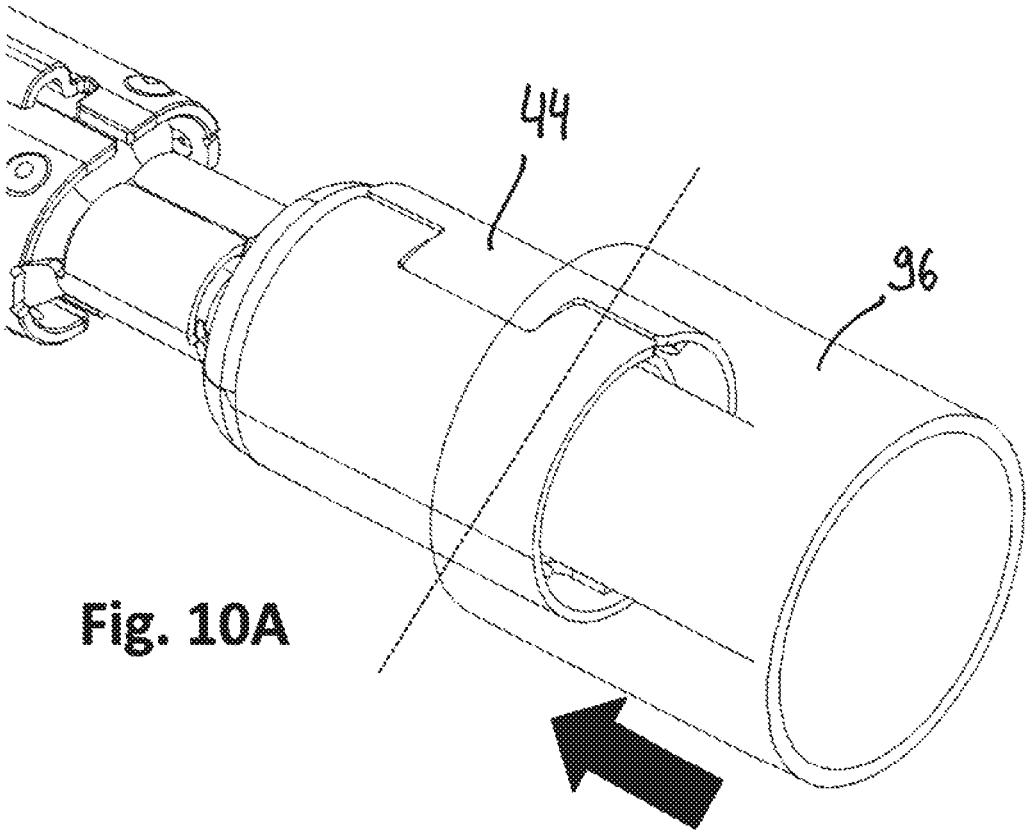
FIG. 10A is a perspective view of a proximal end of a connector wherein a crimp section of the connector is covered by an outer crimping tube according to some embodiments.
Figure 10B:
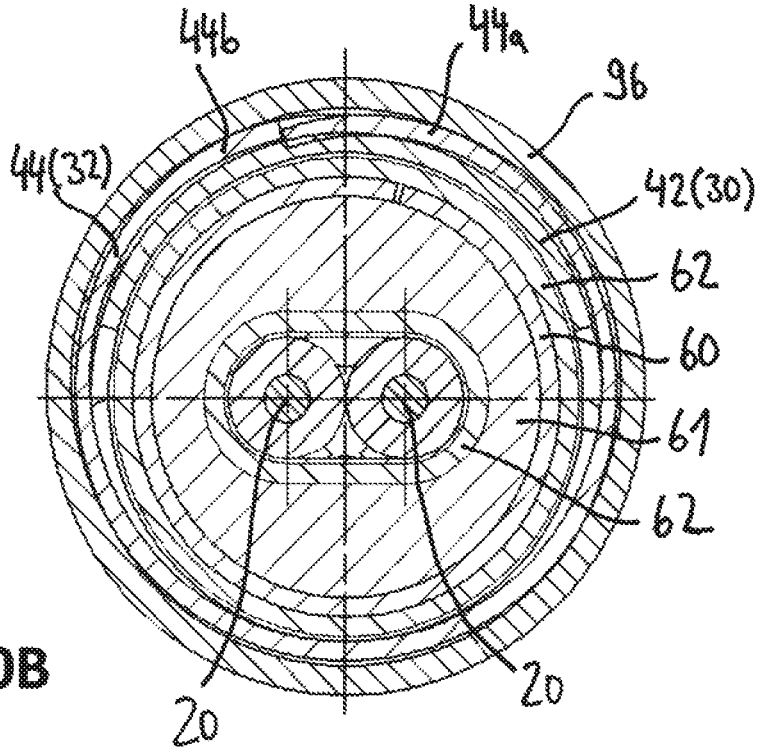
FIG. 10B is a cross-sectional view of the assembly of FIG. 10A along the dashed line of FIG. 10A according to some embodiments.

FIGS. 10A and 10B illustrate an embodiment having an outer crimping tube 96 on the crimping portion 44. In comparison to the cross-sectional view shown in FIG. 7B, in the cross-sectional view of FIG. 10B, there is additionally shown the outer crimping tube 96. The outer crimping tube 96, as is shown in FIG. 10A, can be put on the crimping portion 44 from a cable-side instead of a connector-side. Alternatively, heat shrink tubing, i.e. an plastic tube which shrinks when heat is being applied to it, can be used to cover the crimping portion 44.

Figure 11A:
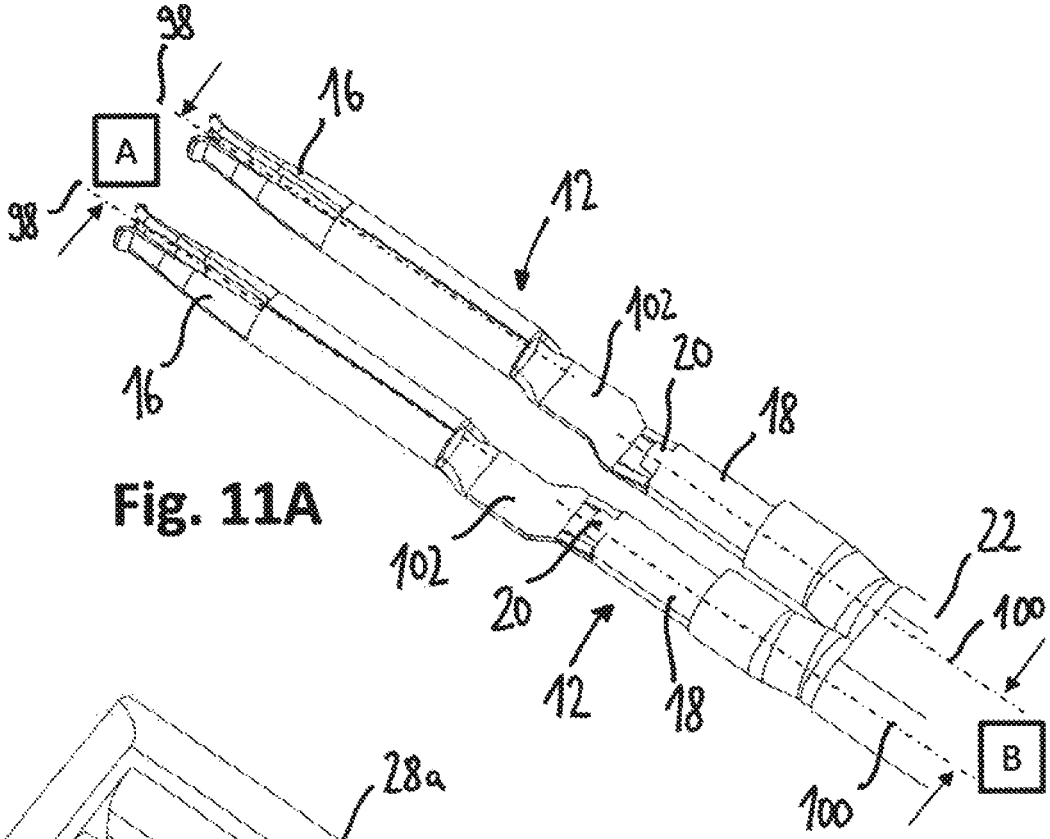
FIG. 11A is a perspective view of inner signal contacts according to some embodiments.
Figure 11B:
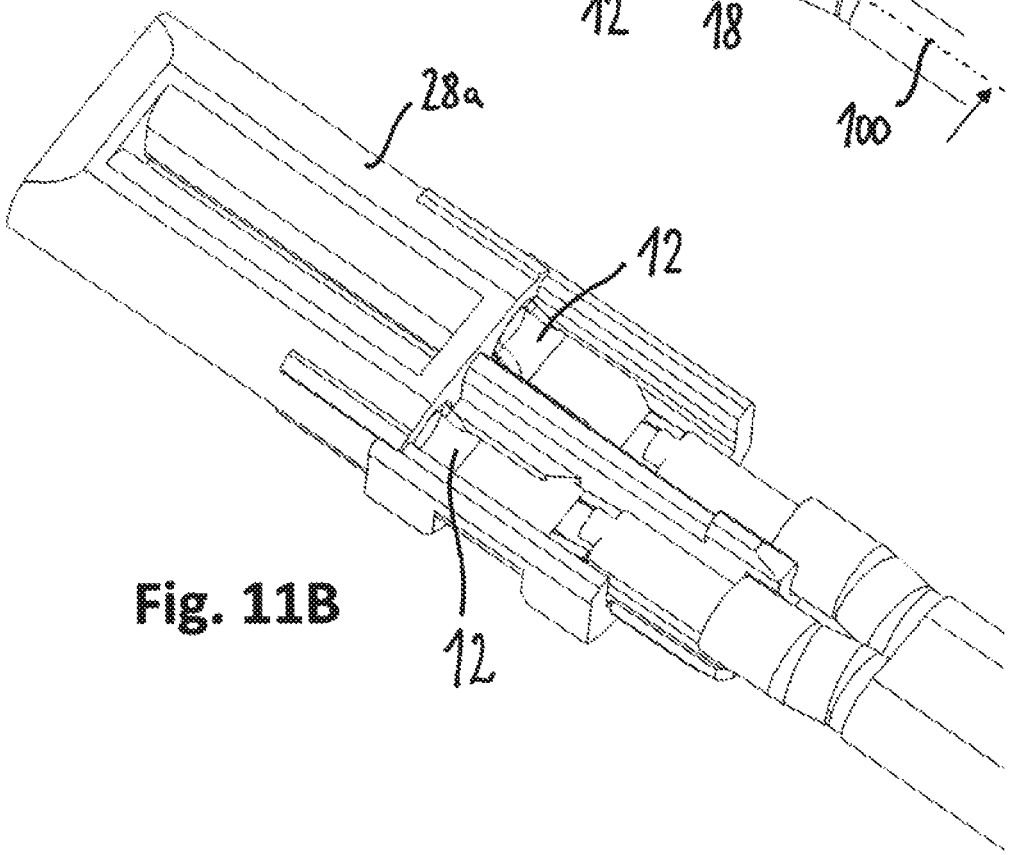
FIG. 11B is a perspective view of the inner signal contacts of FIG. 11A embedded in an insulating element according to some embodiments.

FIGS. 11A and 11B illustrate the inner signal contacts 12 according to a first embodiment. The two elongated inner signal contacts 12 generally extend parallel to one another. Each inner signal contact 12 has a first connection portion 16 for connecting the signal contact 12 to a mating signal contact and a second connection portion 18 for connecting the signal contacts 12 to a respective wire 20 of a cable 22. Each of the first connection portions 16 is formed as a tube having a first center axis 98. Alternatively, the first connection portions 16 can include a solid pin welded into a stamped and rolled rear section to form male signal contacts. Each of the second connection portions 18 define a second center axis 100 where a center axis of the cable is placed at. A distance A between the center axis 98 of the first connection portions 16 is larger than a distance B between the center axis 100 of the second connection portions 18. Alternatively, a distance between the center axis 98 of the first connection portions 16 can be smaller than a distance between the center axis 100 of the second connection portions 18. In other words, the inner signal contacts 12 are formed so that a pitch translation is generated.

Each of the two inner signal contacts 12 are formed so that the first center axis 98 is spaced apart in parallel from the second center axis 100. To achieve this feature, sections 102 of the inner signal contacts 12 extend into a direction oblique to the axial direction 14. For example, the sections 102 can be formed by flat sheet metal or by a tube-shaped cross section. FIG. 11B illustrates the inner signal contacts 12 inserted in the insulating element 28 of FIG. 2A.

Figure 12A:
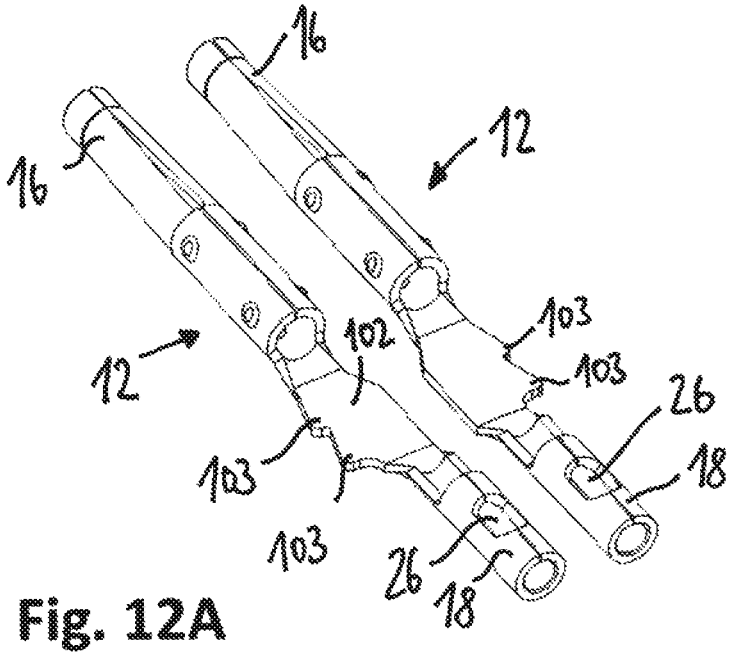
FIG. 12A is a perspective view of inner signal contacts according to some embodiments.
Figure 12B:
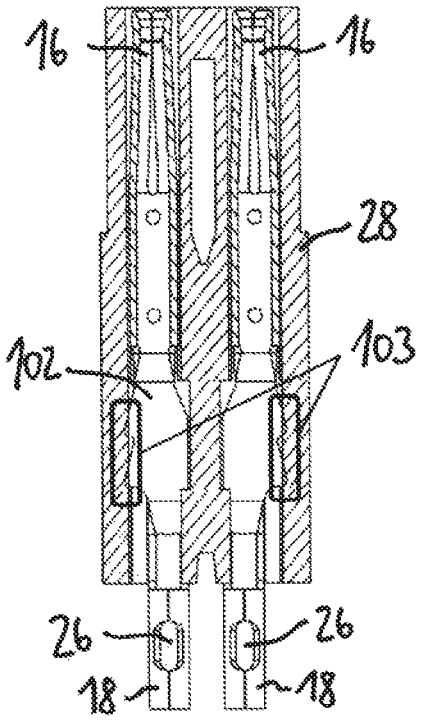
FIG. 12B is a cross-sectional top view of the inner signal contacts of FIG. 12A surrounded by a respective insulating element according to some embodiments.

FIGS. 12A and 12B illustrate inner signal contacts 12 according to a second embodiment. The inner signal contacts 12 differ from the inner signal contacts 12 of FIGS. 11A and 11B in that hooks 103 are formed at side surfaces of the flat sections 102. Hence, the inner signal contacts 12 can be inserted into an insulating element 28 as shown in FIG. 12B and FIG. 3 and can be axially fixated by the hooks 103. Furthermore, in the second connection portions 18 of the inner signal contacts 12, welding openings 26 are formed at an upper side so that the inner signal contacts 12 can be easily connected to the wires 20 of the cable 22 via welding, e.g. laser or resistance welding. Alternatively, not shown crimping wings 24 can be formed at the second connection portions 18 so that the inner signal contacts 12 can be crimped onto the wires 20 of the cable 22.

Figure 13A:
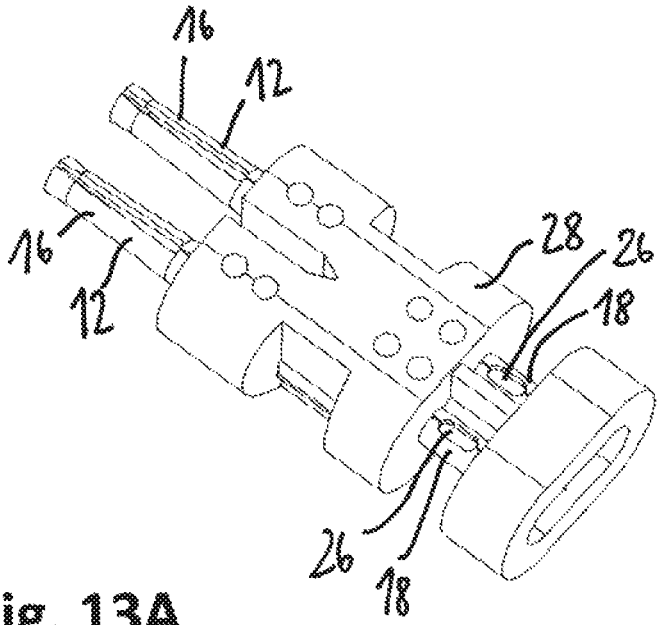
FIG. 13A is a perspective view of overmolded signal contacts according to some embodiments.
Figure 13B:
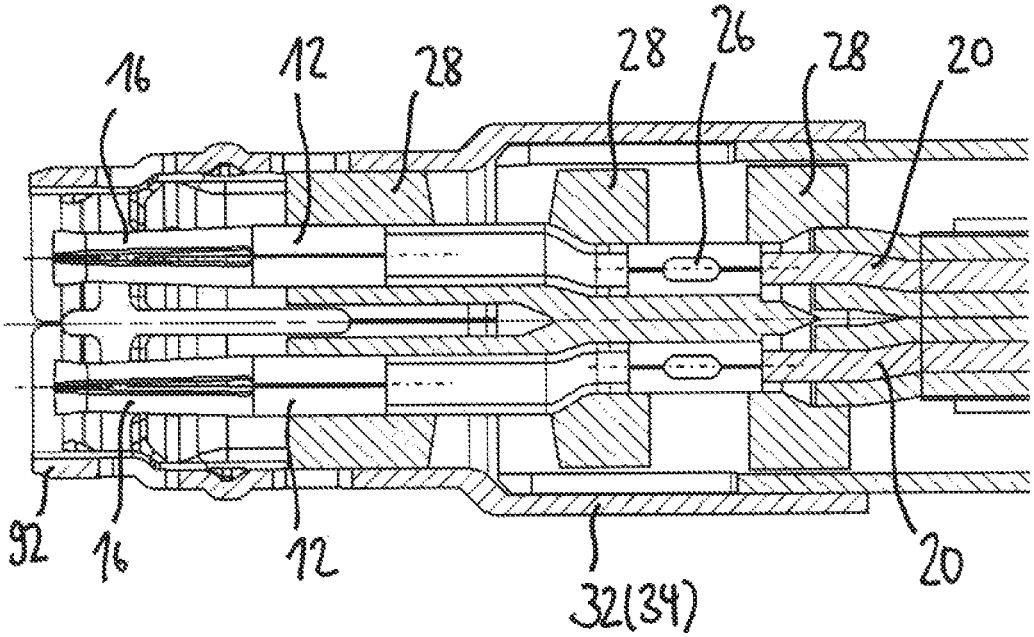
FIG. 13B is a cross-sectional top view of the overmolded signal contacts of FIG. 13A placed in an outer shielding part according to some embodiments.

FIGS. 13A and 13B illustrate the insulating element 28 according to another embodiment. Here, the insulating element 28 is manufactured by overmolding the inner signal contacts 12. To make sure that the mold does not enter the tubular first and second connection portions 16, 18, the tubular portions are sealed during the molding process. Similarly, the welding openings 26 or crimping wings 24 are not overmolded to be able to connect the inner signal contacts 12 to wires 20 of the cable 22 later.

It is possible to overmold each inner signal contact 12 individually and later join the two inner signal contacts 12 instead of overmolding both inner signal contacts 12 together.

Figure 15:
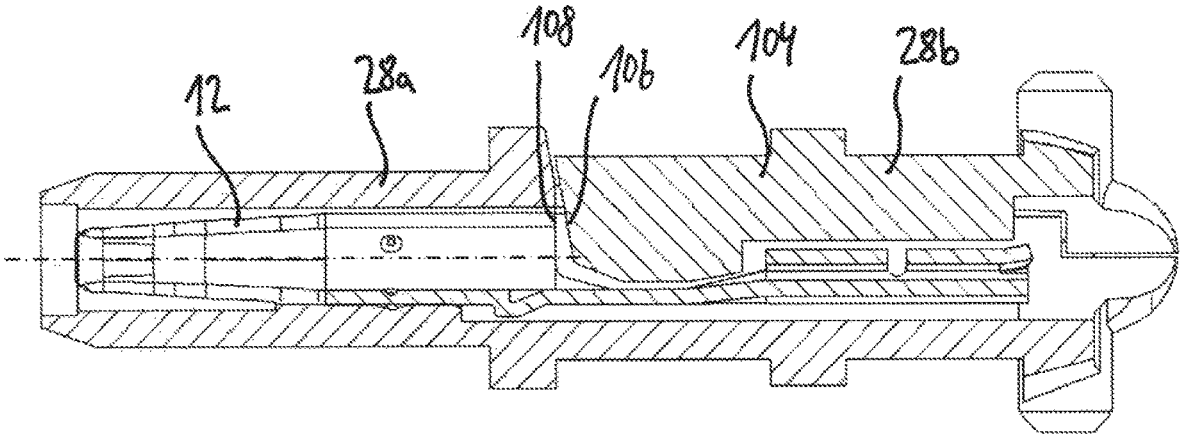
FIG. 15 is a cross-sectional side view of a signal contact embedded in an insulating element according to some embodiments.

FIGS. 14 and 15 illustrate two different possibilities on how to lock the inner signal contacts 12 in the insulating element 28. According to a first embodiment shown in FIG. 14, the insulating element 28 includes a locking element 104 in form of an elastically deformable element which creates a snap fit connection between the inner signal contacts 12 and the insulating element 28 in the axial direction 14. The locking element 104 has a first locking surface 106 which contacts a second locking surface 108 of the inner signal contacts 12 by snapping back from a deformed position into a neutral position in a radial direction. This embodiment allows manufacturing the insulating element 28 as a 1-piece part, e.g. by molding.

Contrary thereto, in the embodiment shown in FIG. 15, the locking element 104 is a solid part which is not formed integrally with the remaining insulating element 28, as is shown in FIG. 14, but instead, the insulating element 28 is made out of two separate parts 28*a*, 28*b* as is shown in FIG. 1. The second part 28*b* of the insulating element 28 functions as the locking element 104 and thus includes the first locking surface 106 which comes into contact with the second locking surface 108 of the inner signal contacts 12, in particular when the connector 10 is plugged into a mating connector. Once the outer shielding contact 34 is assembled, the locking element 104 is blocked in position.

In general, the inner signal contacts 12 can be formed integrally from sheet metal. To manufacture the inner signal contacts 12 in a cost-efficient manner, the inner signal contacts 12 can be designed as stamped/bent parts.

With the above described electrical connector 10, signal integrity can be improved by having less differential impedance mismatch, less long regions of differential impedance mismatch and less skew. The product quality of the electrical connector 10 is improved by providing the cover that separates the cable shield, e.g. a braid, and/or a protective layer from the ends of the crimp wings of the connector. The cover effectively reduces the risk of damaging the cable shield or the protective layer when the crimp wings are formed around the cable shield.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

We claim:

1. An electrical connector, comprising:

an inner signal contact;

an outer shielding contact, wherein the outer shielding contact comprises a crimping portion including a first crimp wing and a second crimp wing bendable towards each other to attach the outer shielding contact to a cable such that ends of the first crimp wing and the second crimp wing extend towards each other when the outer shielding contact is attached to the cable; and a cover for covering a braid or a protective layer of the cable arranged underneath the ends of the crimp wings when the connector is attached to the cable, wherein the outer shielding contact comprises a first outer contact part and a second outer contact part both formed as half shells which together form the outer shielding contact, the first outer contact part forming the first and second crimp wings and the second outer contact part forming the cover, wherein the inner signal contact is connected to respective conductors or wires of the cable via laser welding, wherein a first plurality of spring contacts is integrally formed in the second outer contact part and arranged around the inner signal contact in a region of the second outer contact part opposite from the cover, and wherein a second plurality of spring contacts is integrally formed in the first outer contact part and arranged around the inner signal contact in a region of the first outer contact part opposite from the crimping portion.

2. The electrical connector according to claim 1, wherein the cover is formed of sheet metal.

3. The electrical connector according to claim 1, wherein the first outer contact part or the second outer contact part is generally formed as a half shell.

4. The electrical connector according to claim 1, wherein the first outer contact part or the second outer contact part is formed from sheet metal.

5. The electrical connector according to claim 1, wherein the cover has an arcuate shape.

6. The electrical connector according to claim 1, wherein the first crimp wing or the second crimp wing are provided with openings for welding the first crimp wing or the second crimp wing to the cover.

7. The connector assembly according to claim 1, wherein the outer shielding contact is a male shield contact and wherein the first and second pluralities of spring contacts extend outwardly from the male shield contact.

8. The electrical connector according to claim 1, wherein the first crimp wing defines a first peripheral front face and the second crimp wing defines a second peripheral front face corresponding to the first peripheral front face.

9. The electrical connector according to claim 8, wherein the first peripheral front face comprises a step portion and the second peripheral front face comprises a corresponding step portion.

10. A connector assembly, comprising:

the electrical connector according to claim 1; and a shielded cable attached to the crimping portion of the outer shielding contact.

11. The connector assembly according to claim 10, wherein an outer crimping tube or shrink tube is arranged around the crimping portion.

12. The connector assembly according to claim 10, wherein the first crimp wing and the second crimp wing are welded together when the electrical connector is attached to the cable.

13. The connector assembly according to claim 10, wherein the cable comprises two inner wires and an outer shield and wherein the cover is in direct contact with the outer shield.

14. The connector assembly according to claim 13, wherein the two inner wires are twisted one about the other.

15. The connector assembly according to claim 13, wherein the two inner wires are arranged parallel with one another.

16. The connector assembly according to claim 10, wherein the first crimp wing and the second crimp wing are configured to touch each other when the connector is attached to the cable.

17. The connector assembly according to claim 16, wherein peripheral front faces of the first crimp wing and the second crimp wing are configured to touch each other when the connector is attached to the cable.

* * * * *